US005339586A

United States Patent [19]

Centa

[11] Patent Number: 5,339,586

[45] Date of Patent: Aug. 23, 1994

[54] EDGING STRIPS FOR FLOORCOVERINGS

[76] Inventor: Antony R. Centa, Howe Green Lane, Little Berkhamsted, Hertfordshire SG13 8LH, England

[21] Appl. No.: 66,081

[22] PCT Filed: Nov. 19, 1991

[86] PCT No.: PCT/GB91/02044

§ 371 Date: May 26, 1993

§ 102(e) Date: May 26, 1993

[87] PCT Pub. No.: WO92/09769

PCT Pub. Date: Jun. 11, 1992

[30] Foreign Application Priority Data

Dec. 1, 1990 [GB] United Kingdom ..... 9026202

[51] Int. Cl.[5] ..... E04B 5/48; B32B 3/10

[52] U.S. Cl. ..... 52/220.5; 52/718.01; 52/718.04; 52/730.1; 156/71; 428/33; 428/45

[58] Field of Search ..... 156/71, 91; 52/480, 52/718.01, 718.04, 730.1, 730.3, 731.1, 220.5; 428/33, 45, 95, 192, 582; 16/4, 7

[56] References Cited

U.S. PATENT DOCUMENTS

| | | | |
|---|---|---|---|
| 2,926,378 | 3/1960 | Eichhorn et al. | 16/4 |
| 2,996,751 | 8/1961 | Roby et al. | 428/33 X |
| 3,101,097 | 8/1963 | Murray | 52/220.5 |
| 3,593,472 | 7/1971 | Bargar . | |
| 3,759,000 | 9/1973 | Balzer et al. . | |
| 3,851,674 | 12/1974 | Fork | 52/220.5 X |
| 4,361,614 | 11/1982 | Moffitt, Jr. | 428/192 X |
| 5,003,737 | 4/1991 | Penczak | 52/220.5 X |
| 5,161,339 | 11/1992 | Penczak | 52/220.5 |
| 5,192,599 | 3/1993 | Sakamoto | 428/192 X |

FOREIGN PATENT DOCUMENTS

| | | |
|---|---|---|
| 2933158 | 2/1981 | Fed. Rep. of Germany . |
| 2074142 | 10/1971 | France . |
| 1324729 | 7/1973 | United Kingdom . |
| 2145138 | 3/1985 | United Kingdom . |
| 2187947 | 9/1987 | United Kingdom . |

OTHER PUBLICATIONS

*Engineering News-Record,* Jan. 5, 1956, p. 62, ". . . New Products".

*Primary Examiner*—Mark Osele

*Attorney, Agent, or Firm*—Davis, Bujold & Streck

[57] ABSTRACT

The invention relates to edging strips for fixing floorcoverings, which are particularly suitable for use as dividers between adjacent floor areas. The edging strip comprises interfitting housing and insert strips, the housing strip fitting within the floor surface and presenting an upper edge portion flush with the surface of the floorcovering and the insert strip providing a recessed upper surface to which the underside of the floorcovering edge is fixed, co-operating interlocking projections and recesses being provided whereby the insert strip fixedly locates on the housing strip by pressing down along the length of the insert strip. The insert strip has a locking projection along one edge for engaging in a co-operating recess in the housing strip and a resilient tongue along its other edge projecting downwardly for engaging in a further co-operating recess in the housing strip. The tongue has a locking projection for catching behind a co-operating locking projection in said further recess. The invention provides an edging strip which, when used as a divider, provides a smooth transition between divided floor areas and prevents damage to the floorcovering edges.

6 Claims, 3 Drawing Sheets

Figure 8:
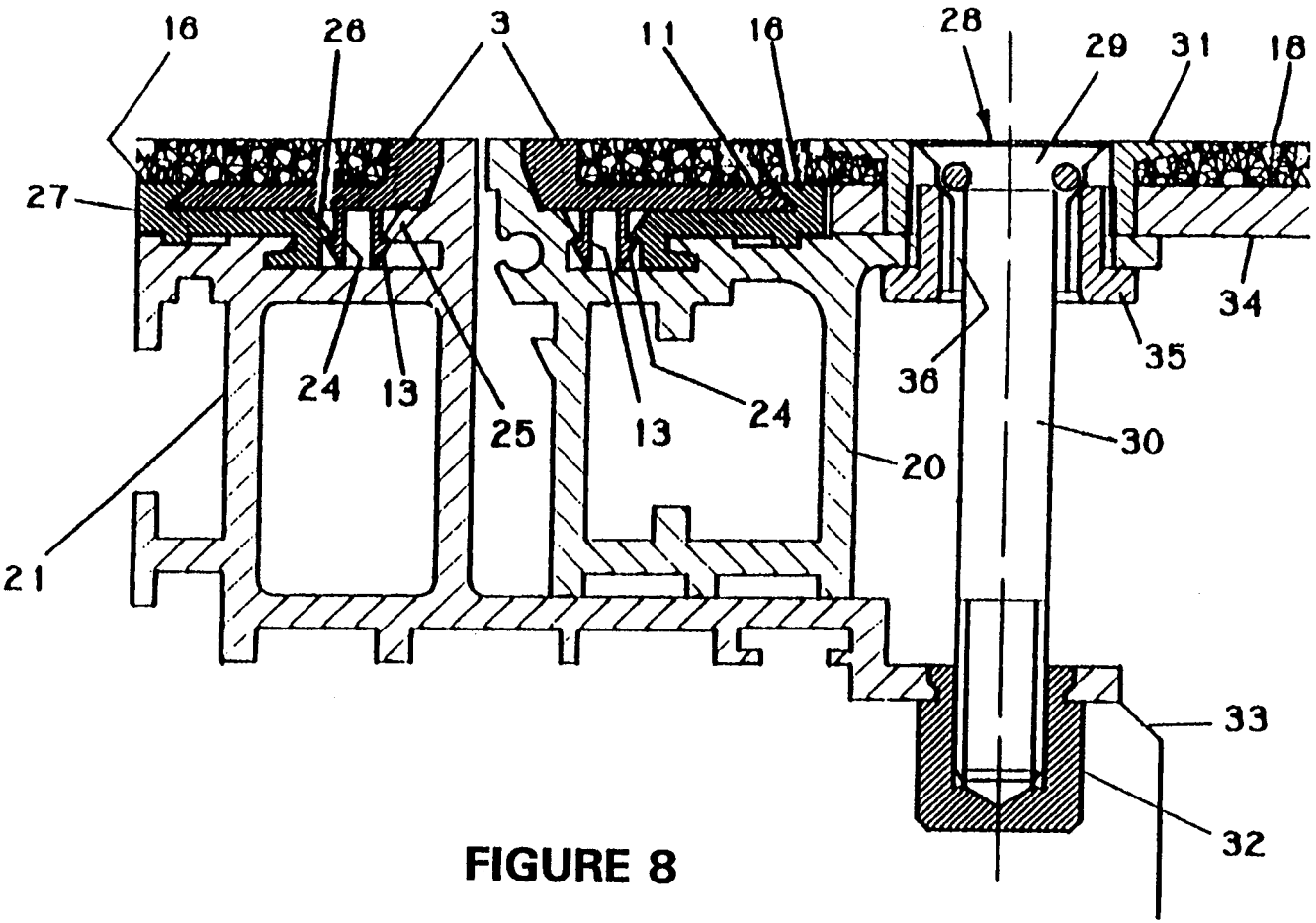

FIGURE 1A
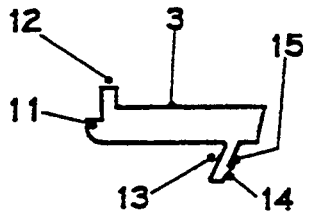
FIGURE 1C
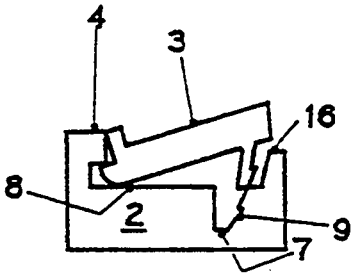
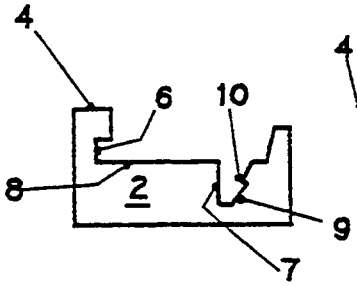
FIGURE 1B
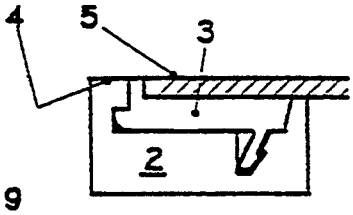
FIGURE 1D
FIGURE 2A
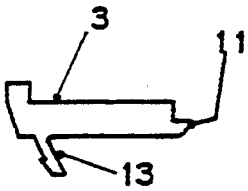
FIGURE 2C
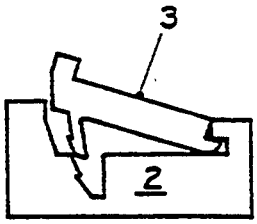
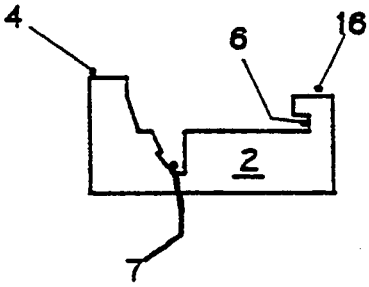
FIGURE 2B
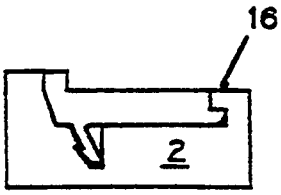
FIGURE 2D FIGURE 3
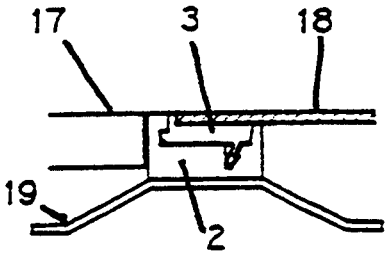
FIGURE 4
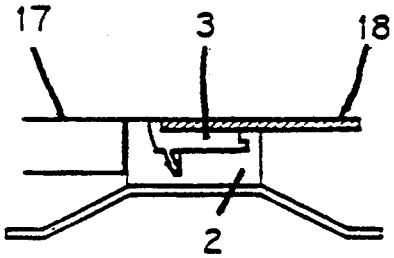
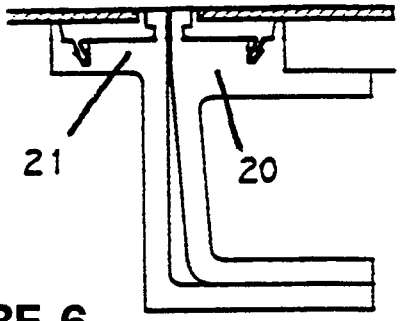
FIGURE 6
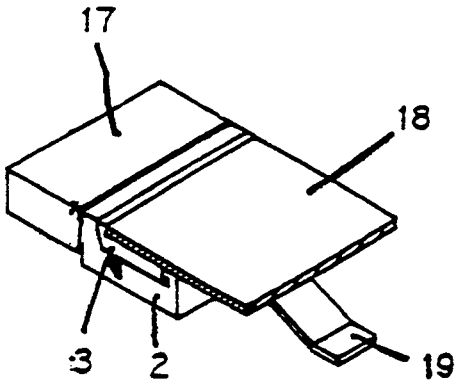
FIGURE 5
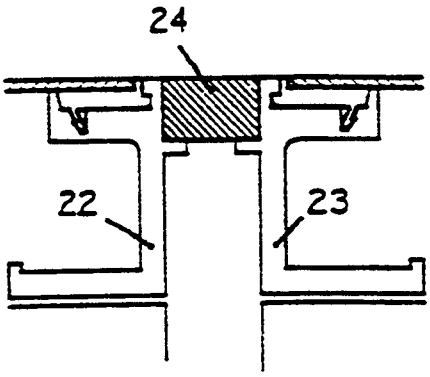
FIGURE 7

EDGING STRIPS FOR FLOORCOVERINGS

This invention relates to edging strips for floorcoverings whereby said covering can be fixedly located along their edges to an underlying floor surface.

Such edging strips can be used for fixing floorcovering around its edges closely adjacent the walls of a room, or they can be used as dividers between two floor areas having different coverings, eg between a tiled floor and a carpet or vinyl flooring.

A particular disadvantage of known edging strips used as dividers is that they tend to project above the surface of the floorcoverings and, even if they are rounded-off, vehicles passing across the dividers tend to be bumped. In circumstances where the vehicles are intended to carry fragile articles, or hospital patients, this is clearly undesirable. Many arrangements for such edging strips have been proposed in an attempt to provide a smooth transition across the dividers, eg as described in GB-PS 2,147,803, 2,184,351 and 2,187,947. All of these arrangements provide a channel member intended to be located in a groove in the floor surface, which member has at least one sloping wall to provide a support surface for the downturned edge of a flexible covering, such as a carpet or vinyl flooring, said edge thereafter being pressed against the support surface by a clamping strip having a similarly sloping, co-operating edge. Where the two areas both require a flexible covering, e.g. where the same floor covering is to be provided on an access cover and the surrounding floor area, the channel member has both of its walls sloping towards each other and both edges of the clamping strip are similarly sloped. The clamping strip is secured along its length by fixing means, such as countersunk bolts, so that its top surface is in alignment with the surface of the floorcoverings. These proposals are relatively expensive to manufacture, and require appreciable fitting time to prepare the floor groove, align the parts, and bolt them in position. Furthermore, for safe-handling and to prevent damage, the sloping edge(s) of the clamping strip cannot present a sharp, feather edge, but must be rounded-off. This inevitably results in a small gap being left between the floorcovering where it is turned down and the clamping strip edge in which dirt can accumulate and over which a vehicle can still "bump" and in time, break down the underlying floor surface.

The object of this invention is to provide an alternative arrangement for the edging strip which, when used as a divider, provides a smooth transition between the divided floor areas.

According to this invention, such an edging strip comprises interfitting housing and insert strips, the housing strip being adapted to be fitted within the floor surface and present an upper edge portion flush with the surface of the floorcovering and the insert strip providing a recessed upper surface to which the underside of the floorcovering can be fixed along an edge thereof, co-operating interlocking means being provided on the housing and insert strips whereby the latter can be fixedly located on the housing strip by pressing down along the length of the insert strip.

Preferably, said insert strip has a locking projection along one of its edges for engaging in a co-operating recess in the housing strip and a resilient tongue extends along the insert strip towards its other edge and projects downwardly from said strip for engaging in a further co-operating recess in the housing strip.

Preferably, said tongue has a sloping engagement surface with a locking projection extending therealong for riding over and catching behind a co-operating locking projection in said further recess, the arrangement being such that, for fitting, said insert strip with the edge of the floorcovering attached is angled to enable the locking projection of said one edge of the insert strip to be engaged in its co-operating recess, and said other edge of the insert strip is pressed downwardly to cause the resilient tongue to enter and be locked within its further co-operating recess.

In one embodiment, the said one edge of the insert strip is adjacent said upper edge portion of the housing strip, and said upper edge portion defines the co-operating recess for the locking projection of said one edge.

In another embodiment, the said other edge of the insert strip is adjacent said upper edge portion.

In order that the present invention may be readily understood, and further features made apparent, two basic embodiments and various applications thereof will now be described, by way of example, with reference to the accompanying drawing, in which:

FIG. 1A–D are sectional views showing a first embodiment of edging strip,

FIG. 2A–D are views similar to FIGS. A1–D showing a second embodiment of edging strip, FIGS. 3, 6 and 7 are sectional views showing three different applications of the first embodiment of edging strip, FIG. 4 is a sectional view of an application corresponding to FIG. 3 for the second embodiment of edging strip, FIG. 5 is a fragmentary perspective view of FIG. 4, and FIG. 8 is an enlarged sectional view of are application corresponding to FIG. 6 for the second embodiment of edging strip Referring to FIG. 1, the edging strip comprises interfitting, elongate housing and insert strips 2,3 respectively. The insert strips are preferably formed from plastics material such as semi-rigid PVC, or ABS, and housing strips are preferably of metal, eg Aluminium Alloy or Brass. The housing strip 2 is intended to be located within a channel in the floor surface and presents an upper edge portion 4 intended to lie flush with the upper surface of the covering 5 of the floor (see FIG. 1D). The upper edge portion 4 defines a recess 6 in its inwardly facing side wall and a shaped further recess 7 is defined in the upper surface 8 from which the portion 4 projects, which surface provides a support for the underside of the insert strip 3. The recess 7 has a sloping engagement face 9 having a locking projection 10 extending longitudinally therealong.

The insert strip 3 is basically of shallow, rectangular shape and one edge is provided with a locking projection, or nose 11 and an upper edge portion 12 intended, when fitted, to lie alongside the edge portion 4 of the housing strip, flush with the covering surface 5. Towards the other edge of the insert strip, a resilient tongue 13 projects from the undersurface and is provided with a sloping engagement face 14 and locking projection 15 which are intended to engage and lock against the corresponding engagement face 9 and locking projection 10 of the housing strip. It will be noted that the insert strip provides a recessed upper surface which is intended to be secured to the undersurface of a flexible floor covering to be used therewith, along an edge thereof. It will be appreciated that the depth of this recess will be equal to the thickness of the particular floor covering. The type of plastics for the insert strip will be chosen in dependence upon the particular floor covering material to be used, and the manner in which it is to be attached to said floorcovering, attachment being effected by suitable means eg a suitable adhesive, heat welding, or a combination of both, or gripping devices.

To interfit the strips, the insert strip 3 is angled downwardly toward its said one edge as shown in FIG. 1C to engage the locking nose 11 in its co-operating recess 6 in the housing strip 2 and the other edge of the insert strip is then pressed downwardly whereby the resilient tongue 13 enters its co-operating recess 7 and flexes into the position as shown in FIG. 1D in which the co-operating projections 15 and 10 are locked together. It will be noted from FIG. 1D that the housing strip 2 has a further upper edge portion 16 spaced from portion 4 and that these two portions, together with the upper surface 8, provide a shallow recess in which the insert strip snugly sits when fitted. The floorcovering may be secured along its edge to its respective insert strip 3 either before, or after location of the strip in the housing strip 2. The adhesive or welding attachment of the floorcovering and inserts strip should be waterproof, and to ensure total protection against moisture penetration under the floorcovering, a mastic can be used between the insert and housing strips during fitting.

Referring to FIG. 2, this embodiment is essentially similar to the FIG. 1 embodiment and like parts are given the same references. Basically the difference is that the locating nose 11 and resilient tongue 13 are reversed on the insert strip 3. Thus, the said other edge of the insert strip lies adjacent the upper edge portion 4 of the housing strip 2 when fitted and the recess 6 for the locking nose 11 is provided in the upper edge portion 16 of said housing strip. This embodiment facilitates unlocking of the interfitting strips 2,3 if for any reason the floorcovering needs to be lifted.

Referring to FIG. 3, this shows an application of the first embodiment described above, which divides a hard floor area 17 e.g. ceramic tiles, from a flexible floorcovering 18, e. g. vinyl flooring. It will be noted that the housing strip 2 is rigidly located in the floor surface by anchor lugs 19 spaced along its length.

FIGS. 4 and 5 show the same application as FIG. 3, but utilizing the second embodiment described above.

Referring to FIG. 6, this shows an application of the first embodiment for an access cover and surrounding frame e.g. as described in my GB-PS 2,145,138B. It will be noted that a housing strip 2 is effectively formed integrally around the upper perimeter 20 of the access cover and also in its surrounding frame 21 and that each housing strip 2 co-operates with an insert strip 3 To which a flexible flooring 18 is attached. Therefore, when viewed from above, only the adjacent upper edge portions 4 of the housing strips 2 are visible.

Referring to FIG. 7 this shows an application of the first embodiment for a floor movement joint in which elongated frame members 22,23 are spaced from each other by a flexible beam 24. It will be noted that the housing strips 2 are again formed integrally in the upper faces of the members 22,23.

It will be appreciated that the second embodiment described with reference to FIGS. 2A–D could equally well be used in the applications described with reference to FIGS. 6 and 7.

Referring to FIG. 8 this shows in greater detail the Application described above with reference to FIG. 6 but utilizing the second embodiment of edging strip with minor modifications. Thus, it will be noted that, the locking projection 11 of each insert strip 3, instead of having a stepped nose has a slanted face which fits against a mating slanting edge undercut from the upper edge portion 16 of its respective housing strip 2. Furthermore, each insert strip 3 has a further resilient tongue 24 which is oppositely arranged with respect to the tongue 13 is shown and the two tongues snap fit between a pair of opposed ribs 25, 26 provided in the upper faces of profile frame sections 20, 21 (which are preferably of aluminium as described in my GB-PS 2,145,138 B) for the access cover and surrounding frame respectively. The rib 26 is formed on an insert piece 27 fixed to each profile section 20, 21. It will be appreciated that such an opposed tongue arrangement enables a tighter fit to be achieved for retaining the insert strip in position. In this embodiment, a holding down bolt arrangement 28 for the access cover is shown. In this arrangement the head 29 of the bolt 30 passes through an aperture in the cover defined by a clamping ferrule 31 for clamping the surrounding floor covering 18 and the bolt is screwed into a threaded socket 32 provided in the mouth 33 of the access opening. The ferrule 31 holds down the floor covering onto a cover decking plate 34 from the inside by an externally threaded bush 35 which additionally has an internal thread 36. In this way, when the bolt 30 is removed, a lifting key ( not shown ) can be screwed into the thread 36 of bush 35 for lifting the access cover. It will be appreciated that a number of such holding down bolts can be provided around the access cover as required.

I claim:

1. A method of securing an edge of a floorcovering fitted to an underlying floor surface, characterised by providing an elongate edging strip comprising a housing strip (2) and an insert strip (3) which are interfitted together via co-operating locking means (6,11,7,13) formed on said strips, selecting the material of said insert strip (3) to be a plastic which will readily bond with the underside of the floorcovering, fixing said edging strip along said floor surface to define a line along which said edge of said floorcovering is to extend so that said housing and insert strips present respective upstanding edges (4, 12) which extend parallel and adjacent each other along said line flush with the surface of the floorcovering (5, 18) when fitted and the insert further presenting a support surface for said, edge of the floorcovering, cutting the floorcovering to present an edge which overlies the support surface of the insert strip and abuts said upstanding edge (12) of the insert strip, and bonding the underside of said floorcovering along said edge to said surface and upstanding edge of the insert strip.

2. A method according to claim 1, further characterised by providing an elongated channel along said floor surface to define said line, and fixing said elongate housing strip within and along said channel.

3. A floor edging strip adapted to secure floorcovering along an edge thereof to an underlying floor surface according to the method of claim 1, characterised by a pair of elongate housing and insert strips (2,3) which are adapted to inter fit with each other, the housing strip (2) having an upstanding edge portion (4) which extends to be flush with the surface of the floorcovering (5, 18) when fitted, and the insert strip (3) being a plastic material to which the underside of the floorcovering can be readily bonded, said insert strip presenting a surface for supporting the underside of the floorcovering along an edge thereof and an upstanding edge (12) which extends to be flush with the surface of the floorcovering when fitted and against which the floorcovering edge abuts, and co-operating interlocking means (6,11,7,13) provided on respective housing and insert strips whereby the insert strip can be fixedly located on the housing strip, said co-operating interlocking means comprising a locking projection (11) provided along one edge of said insert strip and adapted to engage in a co-operating recess (6) provided in the housing strip, and a tongue (13) which extends from the insert strip and is adapted to lock in a further co-operating recess (7) in the housing strip.

4. A floor edging strip according to claim 3, further characterised by said tongue (13) being resilient and extending downwardly from the insert strip, and said recess (7) being provided in the surface of the housing strip, said tongue and recess having respective co-operating sloping engagement surfaces (14, 9) and locking projections (15,10) extending therealong, the arrangement being such that the insert strip can be located over the housing strip and pressed downwardly along its length whereby the locking projection (15) of said resilient tongue rides over and catches behind the co-operating locking projection (10) along said further recess.

5. A floor edging strip according to claim 4 further characterised by a further resilient tongue (24) which is provided on said insert strip, the two tongues being oppositely arranged and adapted to snap fit between a pair of opposed projections (25, 26) and be tightly located therein.

6. A floor surface covered by a floorcovering, characterised by the floorcovering (5, 18) being secured along at least one edge thereof by a floor edging strip according to claim 3.

* * * * *